United States Patent [19]

Lindtveit

[11] 3,960,469

[45] June 1, 1976

[54] REVERSIBLE PUMP

[75] Inventor: Herbert E. Lindtveit, Wheaton, Ill.

[73] Assignee: Sid Harvey, Inc., Valley Stream, N.Y.

[22] Filed: Oct. 23, 1975

[21] Appl. No.: 624,760

[52] U.S. Cl. ..... 418/39

[51] Int. Cl.[2] ..... F01C 13/00; F01C 21/12; F04C 15/02

[58] Field of Search ..... 418/39; 417/239

[56] References Cited

UNITED STATES PATENTS

| | | | |
|---|---|---|---|
| 2,107,152 | 2/1938 | Huber | 418/39 |
| 2,233,709 | 3/1941 | Osborne | 418/39 |
| 2,246,610 | 6/1941 | Wagner | 418/39 |
| 2,655,108 | 10/1953 | Osborne | 418/39 |
| 2,781,726 | 2/1957 | Bangs | 418/39 |
| 2,966,118 | 12/1960 | McAlvay | 417/239 |

*Primary Examiner*—John J. Vrablik

*Attorney, Agent, or Firm*—Cooper, Dunham, Clark, Griffin & Moran

[57] ABSTRACT

This pump is driven by a shaft which may rotate in either direction. The direction of flow of fluid at the inlet and outlet ports of the pump may be maintained the same regardless of the direction of rotation. When the pump is set for one direction of rotation, it may be adapted for use with the other direction of rotation by removing a single plate, turning the plate over, and replacing it. The plate is held by bolts whose removal does not cause disassembly of any other parts.

6 Claims, 6 Drawing Figures

Fig. 3.
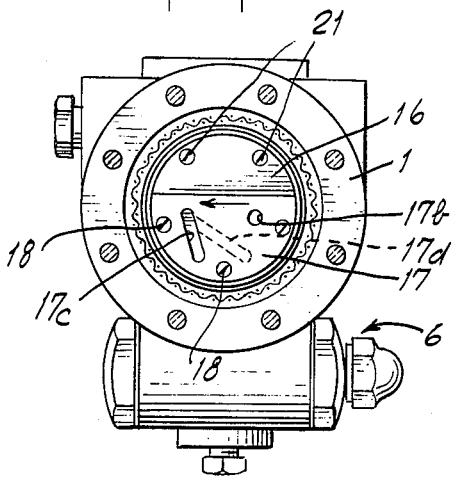
Fig. 4.
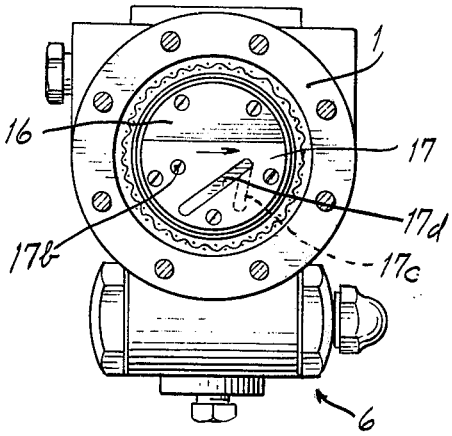
Fig. 5.
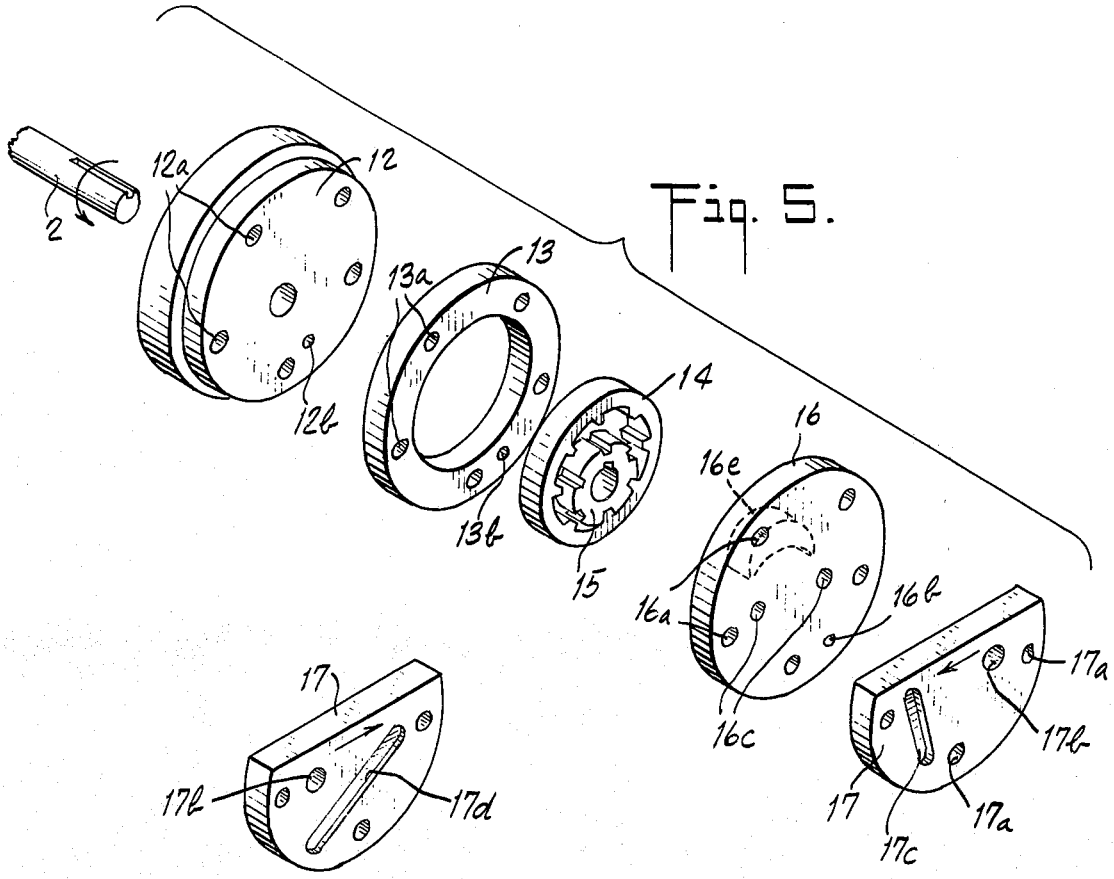
Fig. 6

REVERSIBLE PUMP

BRIEF SUMMARY OF THE INVENTION

This pump is intended as a replacement pump for use on oil burners. Some oil burner drive shafts rotate counterclockwise and some clockwise. It has therefore been necessary for a manufacturer of replacement pumps to stock one line of pumps adapted for one direction of rotation and another line of pumps adapted for the opposite direction. Attempts have been made to solve this problem by providing pump units which, by disassembly and reassembly, could be made to pump fluid in the same direction regardless of the direction of rotation of the pump.

Ths pump of the present invention, when assembled for one direction of rotation, may be adpated for the opposite direction by removing a single plate and the bolts holding it in place, turning the plate over and replacing it and the bolts. No other part of the pump has to be removed or disassembled.

DRAWINGS

FIG. 3 is a sectional view, taken on the line 3—3 of FIG. 1, with the pump set for one direction of rotation of the shaft.

FIG. 4 is a view similar to FIG. 3 with the pump set for rotation of the drive shaft in the opposite direction.

FIG. 5 is an exploded view of the rotary pump, per se.

FIG. 6 is a view of the end plate shown in FIG. 5, but in the reverse position.

DETAILED DESCRIPTION

Figure 1:
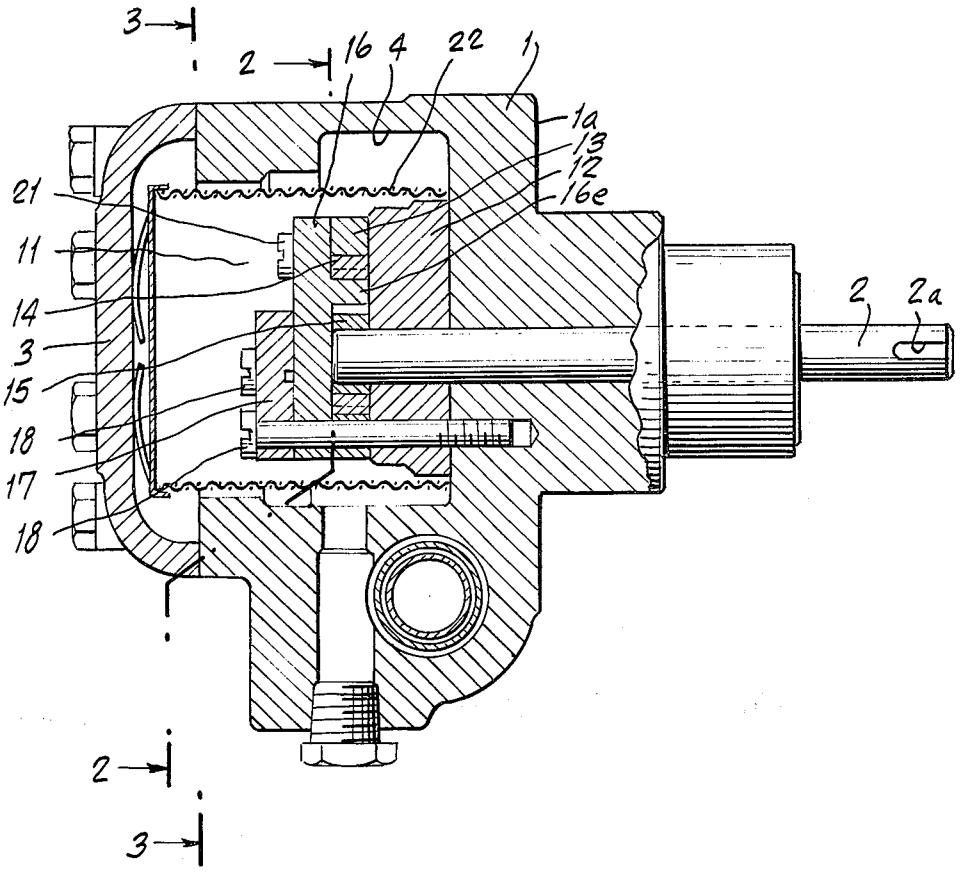
FIG. 1 is a cross-sectional view of a pump assembly embodying the invention, taken on the line 1—1 of FIG. 2.

FIG. 1 illustrates a complete pump assembly including a housing 1 having a surface 1*a* adapted for mounting against a pad on an oil burner. A shaft 2 extends into the housing 1 and is provided at its end with suitable coupling means, such as flats 2*a* for engaging mating coupling means on a motor driven shaft in the oil burner. A cover plate 3 closes the outer end of the casing 1. The casing 1 and cover plate 3 define a chamber 4 connected to an inlet 5 and normally filled with the oil or other fluid to be pumped. A pressure regulating valve 6, of conventional construction, is located in another chamber in the pump housing 1, and delivers the fluid being pumped through a discharge conduit 7 at substantially constant pressure. A gear pump assembly is generally indicated at 11, and includes a base 12, and ring 13 encircling a pump rotor 14 and its cooperating gear 15 which is attached to the shaft 2. A fixed plate 16 has a crescent 16*e* attached to its face nearest the base 12. The crescent 16*e* fits between the rotor 14 and the gear 15. A reversible plate 17 is mounted on the opposite side of the fixed plate 16. The reversible plate is held in place by three bolts 18, which extend through the fixed plate 16, the ring 13 and the base 12 and are threaded into the housing 1.

Two additional bolts 21 extend through the fixed plate 16, the ring 13 and the base 12 into the housing 1. A screen 22 of conventional form, encircles the pump assembly 11.

The base 12 has five holes 12*a* for receiving the bolts 18 and 21, and an outlet passage secton 12*b*. The ring

13 has five holes 13*a* for receiving the bolts 18 and 21 and an outlet passage section 13*b* aligned with the outlet passage section 12*b*.

The fixed plate 16 has five holes 16*a* for receiving the bolts 18 and 21, and an outlet passage section 16*b* aligned with the outlet passage section 12*b* and 13*b*, and two reversible flow passages 16*c*, which are aligned with the points of intake and discharge of the pump rotor 14. The point where the teeth of gear 15 mesh with the teeth of the rotor 14 is always the point of discharge, and the point where the teeth of gear 15 separate from the teeth 14 is always the point of intake. These two points always have the same two locations, but their functions are interchanged when the direction of rotation of the rotor is reversed.

Reversible plate 17 is provided with three holes 17*a* for receiving the bolts 18, and an inlet port 17*b* which extends completely through the plate. With the parts aligned as shown in FIG. 5, port 17*b* provides communciation between the interior of the chamber 4 and the right-hand one of the two reversible flow passages 16*c*. On its outer surface, as viewed in FIG. 5, the plate 17 is provided with a recess 17*c*, shown as a groove. On its inner surface, best seen turned outward in FIG. 6, the plate 17 is provided with a recess 17*d*, shown as a groove. When the plate 17 is assembled with the plate 16 in the orientation shown in FIGS. 3 and 5, the recess 17*d* provides communication between the left-hand one of the reversible passage sections 16*c* and the outlet passage section 16*b*, and the pump is adapted for counter-clockwise rotation of the shaft 2, as illustrated.

Figure 2:
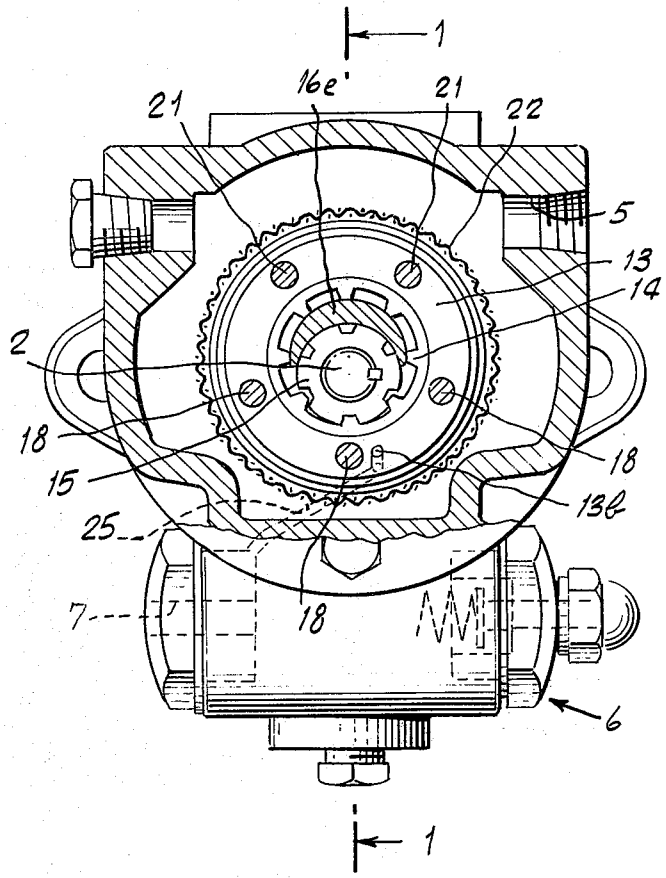
FIG. 2 is a cross-sectional view of a pump taken on the line 2—2 of FIG. 1.

The inlet passage to the pump may be traced through the inlet port 17*b* and the right-hand one of the reversible passages 16*c* to the point where the gear 15 is separating from the teeth of the rotor 14, which is then the intake point of the pump. The left-hand one of the reversible passages 16*c* is then aligned with the point where the teeth of gear 15 mesh with the teeth of the rotor 14, which is then the discharge point of the pump. The path of flow of fluid discharged from the pump extends through the left-hand one of the reversible passages 16*c* through the recess 17*d* to the outlet passage section 16*b* and then through the outlet passage sections 13*b* and 12*b*, and thence through a suitable passage 25 (FIG. 2) to the pressure regulating valve 6 and the discharge conduit 7.

When it is desired to reverse the direction of rotation of the shaft 2, a direction of flow between the inlet 5 and outlet conduit 7 may be maintained the same simply by removing the bolts 18, turning the plate 17 over, so that the surface viewed at the right-hand end in FIG. 5 is against the fixed plate 16, and replacing the bolts 18. The inlet passage to the pump is then through the inlet port 17*b* in the location shown in FIG. 6 and thence through the left-hand one of the reversible passages 16*c* to the intake point where the gears 14 and 15 are separating which is now to the left of the point where gears mesh. The outlet conduit from the pump now extends from the discharge point, i.e., the meshing point of the gears, through the righthand one of the passages 16*c* and the recess 17*c* and thence into the outlet passage sections 16*b*, 13*b* and 12*b*, to the passage 25.

It may be seen that the entire pump unit, as viewed in FIG. 1, may be packaged and carried as a single portable unit, and that the direction of rotation of the shaft may be reversed while maintaining the direction of flow the same simply by reversing the plate 17. This is accomplished by taking out three bolts 18, leaving the other parts of the pump assembly held firmly together by two bolts 21. The plate is then turned over and replaced to the plate assembly by means of the same bolts 18.

When the plate 17 is turned over, it is rotated about an axis extending vertically through the middle one of the holes 17*a*, and contained in a plane extending diametrically through the pump. The inlet port 17*b* and the inlet ends of the recesses 17*c* and 17*d* are located symmetrically with respect to that axis about which the plate is rotated. In other words, the inlet port 17*b* is a certain distance to one side of that axis and the inlet ends of both recesses 17*c* and 17*d* are the same distance to the opposite side of the same axis. The two reversible flow passages 16*c* in the fixed plate 16 are also symmetrically located with respect to the diametrical plane containing that axis, so that in either position of the plate 17, the inlet port 17*b* is aligned with one of the passages 16*c*, and the inlet end of one of the recesses 17*c* and 17*d* is aligned with the other one of the two passages 16*c*.

The fixed plate has a circular contour. The plate 17 is a segment of a circle somewhat greater than a semicircle. By so constructing the plate 17, the bolts 21, which remain in the pump when the plate 17 is removed, prevent the plate from being assembled in any wrong orientation. In other words, after the plate 17 has been removed and rotated about the vertical axis through the middle hole 17*a*, there is only one orientation in which it can be reassembled with the pump without interfering with the heads of the two remaining bolts 21.

The pump illustrated is intended for submerged operation. In other words, it is enclosed in the chamber 4 which is filled with the fluid to be pumped. Under these circumstances, the pump inlet conduit is simply the port 17*b* and the aligned passage 16*c*. The apparatus of the invention might be used in other installations where the pump is not submerged, in which case an external inlet conduit could be attached to the port 17*b*, which could be threaded to receive a fitting forming part of the conduit.

While the invention is illustrated as applied to a gear pump of the fixed crescent type, including an externally toothed gear cooperating with a larger internal toothed gear, it is equally applicable to pumps of other types, including, for example, gear pumps in which both gears have external teeth and rotary sliding vane type pumps.

While the outlet passage arrangement shown, including the sections 12*b* and 13*b*, has many advantages, for example, the advantage of simplicity, it should be understood that other outlet passage arrangements may come within the broader aspects of my invention.

I claim:

1. A rotary pump, comprising:

a. a shaft adapted to be driven in either direction;

b. a reversible pump rotor driven by the shaft;

c. a fixed member facing the side of the rotor opposite the shaft and having first and second reversible flow passages extending therethrough and aligned with the points of intake and discharge from the rotor, said points being reversed as to function when the direction of rotation of the rotor is reversed, and an outlet port opening in the face of the fixed member opposite the rotor;

d. a reversible plate having an inlet port extending therethrough, a recess in one surface adapted, when that surface is facing the fixed member, to provide fluid communication between one of said first and second reversible flow passages and the outlet port, and a recess in the opposite surface adapted, when the opposite surface is facing the fixed member, to provide fluid communication between the other of said first and second reversible flow passages and the outlet port; and e. means holding said reversible plate against the fixed member, said pump being adaptable to maintain the same direction of flow through its inlet and outlet ports when the direction of rotation of the rotor is reversed, by removing the holding means and the reversible plate, turning the plate over and replacing the holding means.

2. A rotary pump as in claim 1 including second holding means maintaining said fixed member in place, said second holding means remaining fixed during reversal of said reversible plate, so that only the first-mentioned holding means and the plate have to be removed to adapt the pump for reversal of the direction of rotation of the rotor.

3. A rotary pump as in claim 1, in which said pump is submersible in a chamber filled with a fluid to be pumped, so that said inlet port is in direct communication with the fluid in said chamber.

4. A rotary pump as in claim 1, in which:

a. said fixed member is a circular plate;

b. said reversible plate is segmental and has a periphery aligned with a portion of the periphery of the first plate;

c. said holding means comprises:

1. a first plurality of bolts extending through both said plates; and 2. a second plurality of bolts extending through said circular plate in a region thereof not covered by the reversible plate in its operating position, said second plurality of bolts having heads projecting beyond said fixed plate and preventing assembly of the reversible plate in an improper orientation with respect to the fixed plate.

5. A rotary pump as in claim 1, in which:

a. said reversible flow passages are equally spaced from and on opposite sides of a plane extending diametrically through said pump;

b. when said reversible plate is in either operating position, said inlet port is spaced from said plane on one side thereof by a distance equal to the spacing of said passages from said plane, and the inlet ends of said grooves are spaced from said plane on the opposite side thereof by said equal distance.

6. A rotary pump, comprising:

a. a shaft adapted to be driven in either direction;

b. a base in which the shaft is journaled and having a first outlet passage section therein opening through a surface thereof;

c. a reversible pump rotor driven by the shaft and running in contact with said surface;

d. a ring encircling the rotor and having a second outlet passage section therein aligned with the first outlet section;

e. a fixed member facing the side of the rotor opposite the shaft and having first and second reversible flow passages extending therethrough and aligned with the points of intake and discharge from the rotor, said points being reversed as to function when the direction of rotation of the rotor is reversed, and an outlet port aligned with said second outlet passage section;

f. a reversible plate having an inlet port extending therethrough at an eccentric location, a recess in one surface adapted, when that surface is facing the fixed member, to provide communication between one of said first and second reversible flow passages and the outlet port; and a recess in its opposite surface adapted, when the opposite surface is facing the fixed member, to provide communication between the other of said first and second reversible flow passages and the outlet port; and g. bolt means holding said reversible plate against the fixed plate, said pump being adaptable to maintain the same direction of flow through its inlet and outlet ports when the direction of rotation of the rotor is reversed, by removing the bolt means and the reversible plate, turning the plate over and replacing the bolt means.

* * * * *